United States Patent [19]

Vassallo

[11] 4,028,989

[45] June 14, 1977

[54] BULLET EXTRACTOR

[76] Inventor: Alphonse C. Vassallo, 1439 Wayland, San Francisco, Calif. 94134

[22] Filed: July 24, 1975

[21] Appl. No.: 598,555

[52] U.S. Cl. ..... 86/1 A; 81/3.05; 86/23

[51] Int. Cl.[2] ..... C06B 21/00

[58] Field of Search ..... 86/1 R, 1 A, 23, 24, 86/42, 43; 81/3.05; 124/74, 75, 76, 66, 67, 69, 82; 273/106 E; 89/14 SB

[56] References Cited

UNITED STATES PATENTS

| | | | |
|---|---|---|---|
| 2,349,248 | 5/1944 | Costello | 86/1 A |
| 2,824,482 | 2/1958 | North | 86/1 A |
| 2,881,752 | 4/1959 | Blahnik | 124/75 |
| 3,340,769 | 9/1967 | Waser | 89/14 SB |
| 3,476,048 | 11/1969 | Barr et al. | 89/14 SB X |
| 3,837,107 | 9/1974 | Swaim | 42/1 F |
| 3,898,908 | 8/1975 | Isenhower | 86/1 A |

*Primary Examiner*—Harold Tudor
*Attorney, Agent, or Firm*—Robert G. Slick

[57] ABSTRACT

A machine for disassembling cartridges is provided wherein the inertia of the bullet pulls the bullet from the cartridge case so that the bullet, cartridge case, and powder can be recovered undamaged.

4 Claims, 12 Drawing Figures

BULLET EXTRACTOR

SUMMARY OF THE INVENTION

It is frequently desirable to be able to disassemble cartridges. For instance, in the manufacture of cartridges, a defective lot could be produced or in storing cartridges, cartridges may deteriorate. In such instances, it is highly desirable that the parts of the cartridge be disassembled in as good a condition as possible since the cartridge case can ordinarily be reloaded and even the bullet might be reused.

Various devices have been proposed in the past for performing such an operation, but all of them involved physically engaging the case and the bullet and pulling them apart. Such an operation is slow and dangerous and ordinarily some of the recovered metal becomes scratched.

In accordance with the present invention, a device is provided for disassembling amunition wherein the case and bullet are handled gently so that they can be recovered substantially without being scratched.

A further object of the invention is to provide a machine for disassembling cartridges wherein there is little likelihood of the cartridge exploding and, if it does explode, will cause a minimum amount of damage.

Another object of the present invention is to provide a machine which is substantially automatic in operation so that a large number of cartridges can be disassembled with a minimum amount of cost.

Various other objects and features of the invention will be brought out in the balance of the specification.

DESCRIPTION OF THE PREFERRED EMBODIMENTS

Figure 1:
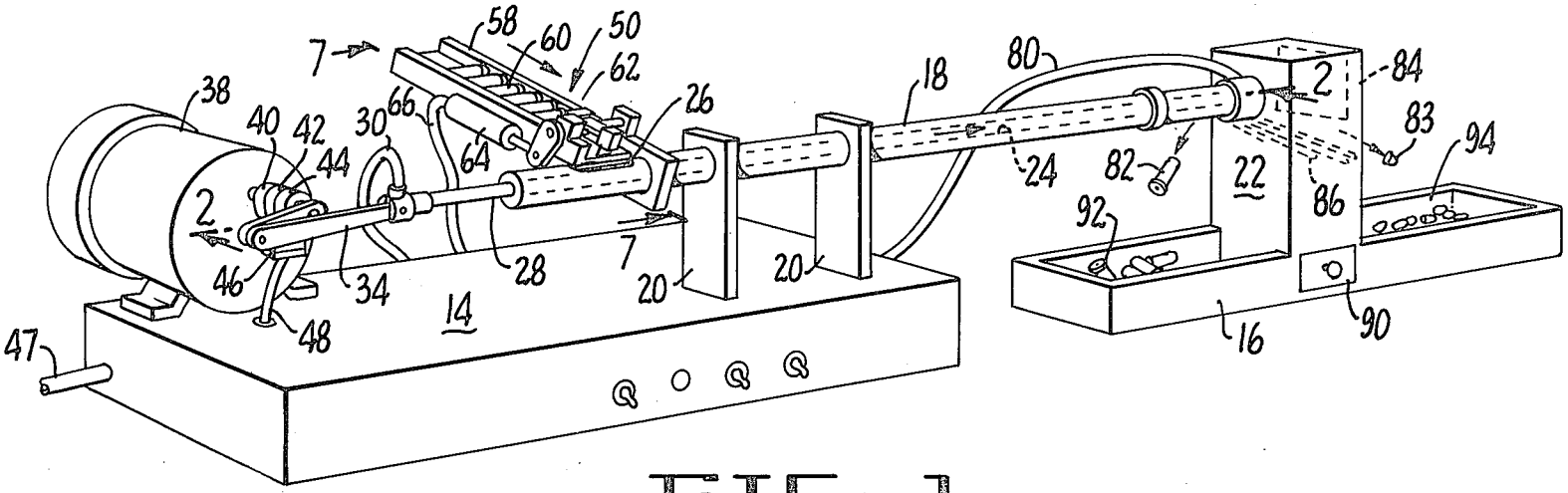
FIG. 1 is a perspective view of a machine embodying the present invention.
Figure 2:
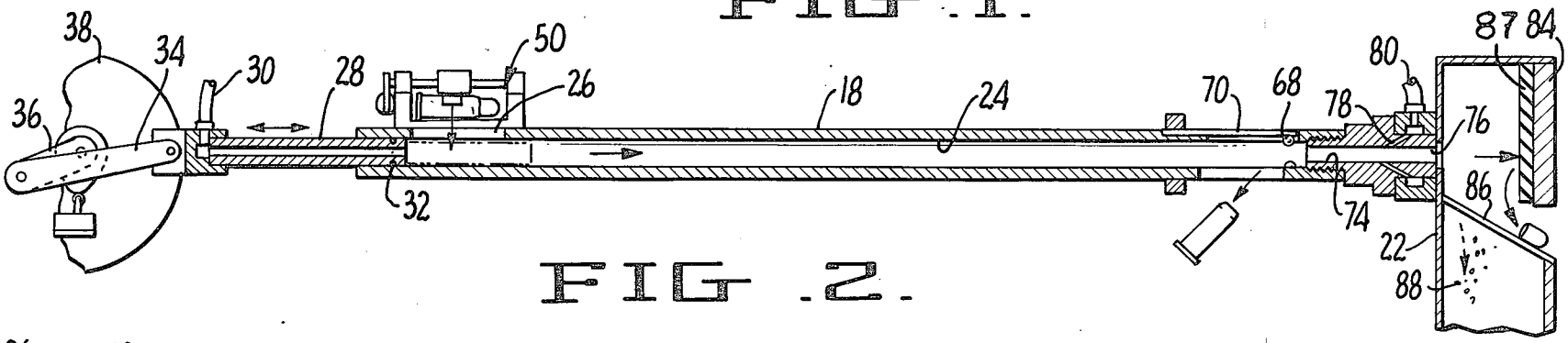
FIG. 2 is a section on the line 2—2 of FIG. 1.
Figure 6:
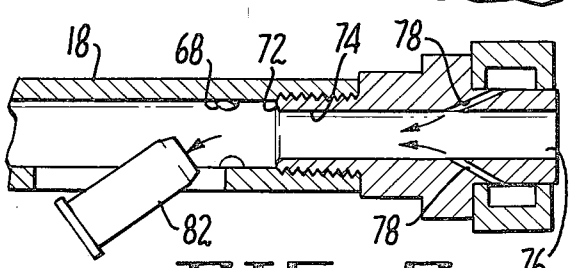
FIG. 6 is a section showing the extraction and ejection of a cartridge case.

Referring now to FIGS. 1 through 7, there is shown a cartridge unloading device mounted on a first base 14 and a second base 16. A barrel 18 is mounted on uprights 20 on base 14, and upright 22 on base 16. The barrel has a smooth bore 24 which is just sufficient in size to allow passage of the largest dimension of a cartridge to be disassembled. This relationship is clearly shown in FIGS. 3 through 5. The barrel has a breech 26 which is sufficiently long to allow a cartridge to pass into the breech. Behind the breech is a piston-like member 28 which is hollow and connected to a source of gas through tube 30. The forward part of the piston 28 is provided with a sealing O ring 32. At the opposite end the piston rod is pivoted to arm 34 which is connected to crank 36 actuated by motor 38. Motor 38 also carries cams 40, 42 and 44 which operate switches 46 and which are connected by cable 48 to air valves (not shown) within the base 14. Compressed air is supplied to the valves through line 47. Mounted adjacent to the breech 26 is a magazine 58 adapted to hold a number of rounds 60 which are to be disassembled. Feeder 62, actuated by pneumatic cylinder 64 from air hose 66, causes the rounds to be fed into the breech 26 one at a time. Near the discharge end of barrel 18, balls 68 have leaf springs 70 which tend to push the balls partway into the bore 24. The function of these will be later explained. Beyond the balls 68 is a chamfered shoulder 72. The bore 74 beyond the shoulder is of reduced diameter. The barrel is open at 76 and air injection ports 78 are provided near the open end which are connected by means of tubing 80 to the air control valves in base 14. The dimension of the reduced portion 74 corresponds with the body diameter 82 of a cartridge.

Member 22 serves as a support for the end of the barrel 18, at the open end 76 and beyond this open end is a heavy steel plate 84 which serves as a safety precaution in the rare instance of a shell exploding. Mounted below the opening 76 is a coarse screen 86 which leads to a closed chamber 88 having an access door 90. The base 16 has a compartment 92 for receiving empty casings and a similar bin 94 for receiving extracted projectiles Rubber cushion 87 prevents damage to the extracted projectile.

Figure 5:
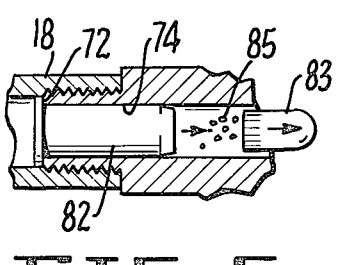
FIG. 5 is a fragmentary section showing the bullet and case shortly after separation.
Figure 4:
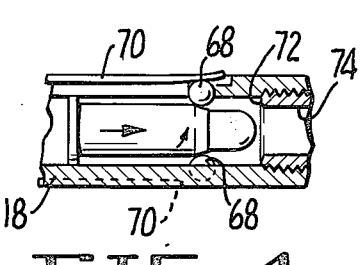
FIG. 4 is a fragmentary section showing the straightening action within the barrel.
Figure 3:
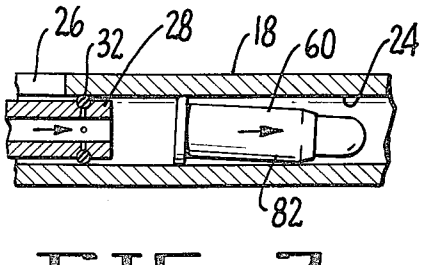
FIG. 3 is a fragmentary section showing the position of the parts at the time the cartridge is first accelerated.
Figure 7:
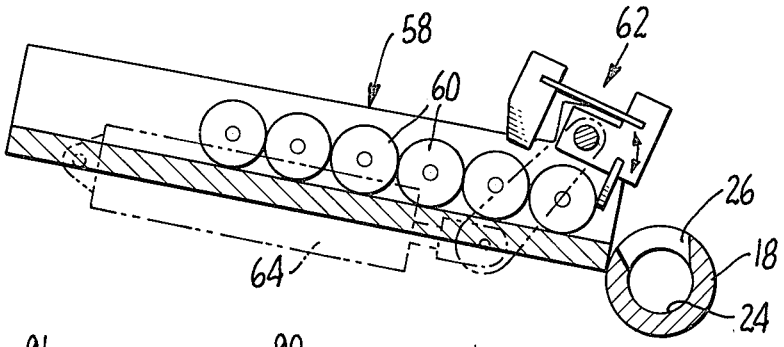
FIG. 7 is an enlarged section on the line 7—7 of FIG. 1.

The overall operation of the device can now be described. As the motor rotates, crank 34 draws piston 28 to its extreme "out" position and cam 40, acting through switch 46, causes a pulse of air in line 66 which actuates cylinder 64, allowing a single round to fall through the breech 26. As the motor turns, piston 28 forces the cartridge beyond the breech and the sealing ring 32 seals the end of the barrel 18. At this point, cam 42 causes a pulse of air through line 30 which causes the round 60 to be propelled through the barrel at a high rate of speed. As can be seen in FIG. 3, the front end of the round is not supported so that it moves through the smooth bore at somewhat of an angle but as it approaches shoulder 72, the balls 68 center the round as is shown in FIG. 4, so that as the bullet starts entering the reduced chamber 74 it is perfectly centered. Now, as the extraction rim of the rounded reaches shoulder 72 it will be suddenly stopped as is shown in FIG. 5, while inertia will cause the bullet 83 and the powder 85 to continue. Bullet 83 strikes plate 87, falls off the screen 86 into the bin 94, while the power 85 falls through the screen 86 into the chamber 88 and it can be removed from the chamber by opening the door 90. Now a pulse of air passes through line 80, controlled by cam 44. This causes a blast of air through the lines 78 causing the spent case to fall into the bin 92. Thus, it will be seen that the action is entirely automatic and it is only necessary to load the magazine 58 from time to time.

Figure 8:
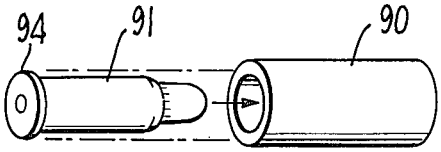
FIG. 8 is a perspective view showing the manner in which a cartridge may be protected in a carrier cylinder during the extraction operation.
Figure 9:
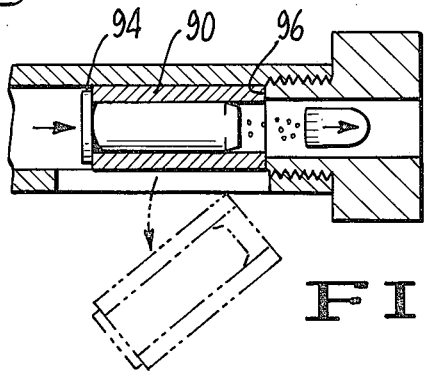
FIG. 9 shows a modified extraction station when the carrier is being used.

In some instances, it has been found that cases will be scratched during passage down the barrel. In this instance, the modification shown in FIGS. 8 and 9 can be employed to insure that the case will be handled in a very gentle manner. Here, a hollow cylinder 90 is placed over the bullet 91, and as can be seen in FIG. 9, cylinder 90 has a diameter larger than the extraction rim 94 of the bullet. Further, shoulder 96 is not tapered as was previously described but forms a flat surface mating with that of the cylinder 90. Since the extraction rim 94 is already in contact with cylinder 90, there will be no relative movement when the cylinder hits the shoulder 96. Thus, any scratching which might take place would be between the shoulder 96 and the end of cylinder 90 and not between the cylinder and the end of the round. The operation is exactly as previously described except that the cylinders must be fitted over the rounds before they are placed in the magazine 58 and the cylinders and cartridge case are ejected together as is shown in dot/dash lines in FIG. 9.

Figure 11:
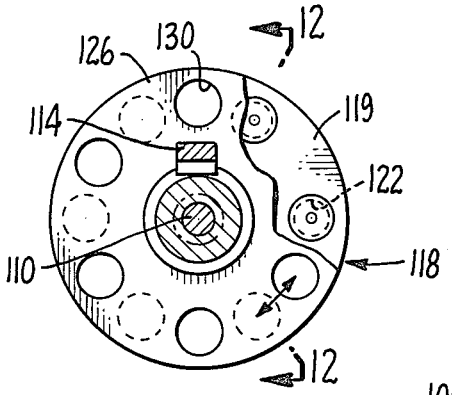
FIG. 11 is a section on the line 11—11 of FIG. 10.
Figure 10:
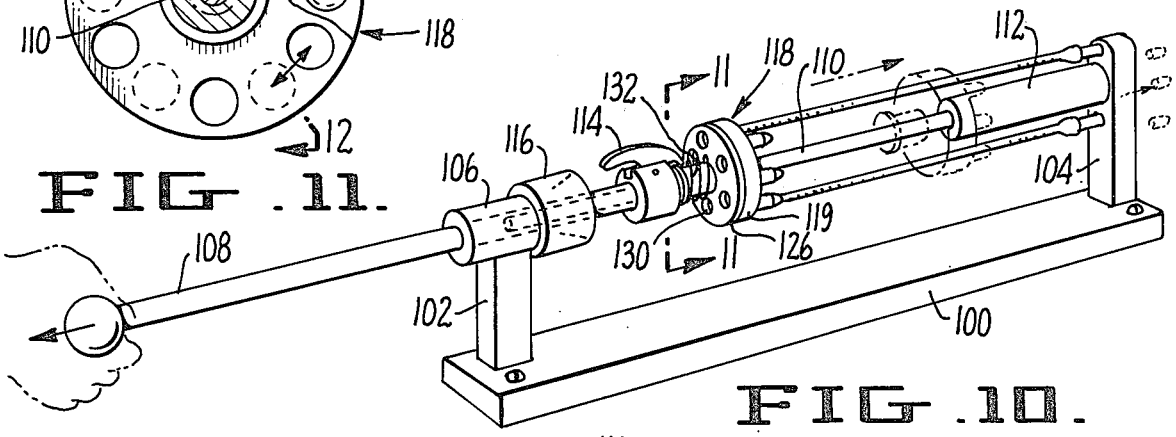
FIG. 10 is a perspective view of a simplified form of hand-operated ejection device.
Figure 12:
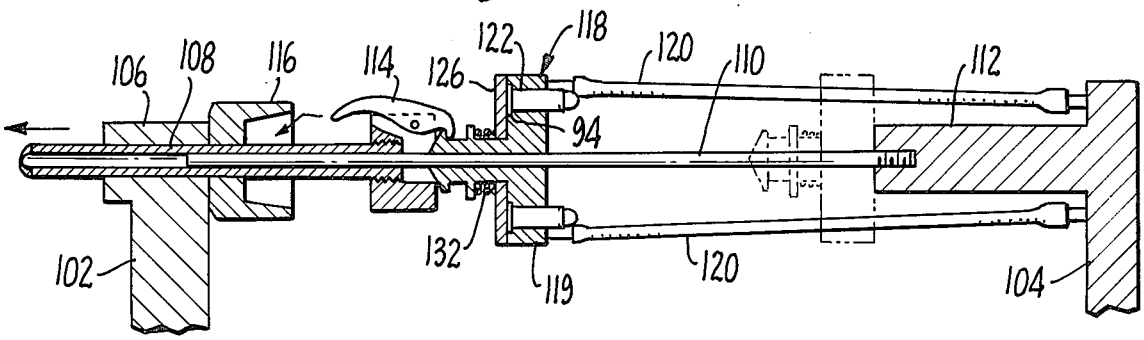
FIG. 12 is an enlarged section on the line 12—12 of FIG. 11.

In FIGS. 10 through 12, a simple hand-operated model of the device is shown which operates on exactly the same principle. Here, a base 100 has arms 102 and 104. Arm 102 supports a bushing 106 having a tube 108 which can slide through busing 106. Tube 108 slides over rod 110 held to extension 112 on support 104. Tube 108 carries a latch 114 while a latch release 116 is provided on support member 102. The cartridge holder generally designated 118 is slidably mounted on rod 110 and is biased by spring members 120. The spring members 120 can be heavy rubber bands. Cartridge holder 118 consists of two circular plates 119 and 126. Plate 119 has a plurality of holes 122 therein which are just of sufficient size to pass the body of a cartridge but to not pass the extraction rim. Plate 126 has holes 130 which are of sufficient size to pass the entire cartridge. Plates 119 and 126 can rotate relative to each other and spring 132 tends to hold the plates in any position in which they are placed. To operate the device, plate 126 is rotated so that its openings line up with the openings of plate 119 and cartridges are placed in these openings. Plate 126 is then rotated to cover the cartridges and rod 108 is pulled as is shown in FIG. 10. When the release 116 contacts latch 114, the plate 118 will slide down rod 110 propelled by the spring members 120 until the plate hits the extension 112. Plate 118 will come to a sudden stop and the projectiles and powder will be ejected as previously described. Plate 126 can now be rotated, the empty cartridges removed, and the device reloaded for a repetition of the operation.

Although certain specific embodiments of the invention have been shown, it will be understood that many variations can be made in the exact structure shown without departing from the spirit of this invention.

I claim:

1. A device for disassembling cartridges wherein said cartridge consists of a casing containing a propellant with a bullet therein, said casing having an extraction rim larger than the body of the casing, said device having a barrel, said barrel having a breech adjacent the entrance end, said barrel having a diameter sufficient to pass an entire cartridge case, means for propelling said catridge through said barrel and a reduced portion at the terminal end of said barrel, said reduced portion being of sufficient diameter to pass the cartridge body but to not pass the extraction rim of the cartridge, whereby the extraction rim is engaged and stopped and the projectile and the powder is extracted from said case by inertia.

2. The structure of claim 1 wherein a magazine is provided for holding a plurality of cartridges and means for automatically feeding said cartridges, one at a time, into said barrel.

3. The structure of claim 1 wherein a reciprocating member is provided in the entrance end of said barrel adapted to push a cartridge case beyond said breech and means whereby said cartridge case is propelled through said barrel by means of compressed air.

4. The structure of claim 1 wherein the cartridge case is surrounded by a removable collar during the extraction operation.

* * * * *